US008447218B2

(12) United States Patent
Yamana

(10) Patent No.: US 8,447,218 B2
(45) Date of Patent: May 21, 2013

(54) FIXING APPARATUS

(75) Inventor: Shinji Yamana, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 307 days.

(21) Appl. No.: 12/862,886

(22) Filed: Aug. 25, 2010

(65) Prior Publication Data

US 2012/0051808 A1 Mar. 1, 2012

(30) Foreign Application Priority Data

Sep. 3, 2009 (JP) ..... 2009-203381

(51) Int. Cl.
*G03G 15/20* (2006.01)

(52) U.S. Cl.
USPC ..... 399/329

(58) Field of Classification Search
USPC ..... 399/165, 329
See application file for complete search history.

(56) References Cited

U.S. PATENT DOCUMENTS

| | | | | |
|---|---|---|---|---|
| 6,274,846 | B1 * | 8/2001 | Ono et al. | 219/216 |
| 2009/0279928 | A1 * | 11/2009 | Ishikawa | 399/323 |

FOREIGN PATENT DOCUMENTS

| | | |
|---|---|---|
| JP | 04-133926 | 5/1992 |
| JP | 04-371983 | 12/1992 |
| JP | 06-032480 | 2/1994 |
| JP | 2008-058458 | 3/2008 |

OTHER PUBLICATIONS

Translation of Junichi (JP,06-032480,A), pub date: Feb. 1994.*
Translation of Ono (JP,2009-029611, A), pub date:Feb. 12, 2009.*

* cited by examiner

*Primary Examiner* — Walter L Lindsay, Jr.
*Assistant Examiner* — Frederick Wenderoth
(74) *Attorney, Agent, or Firm* — Renner, Otto, Boisselle & Sklar, LLP

(57) ABSTRACT

A fixing roller 3 is provided with a regulating member 40 that moves in an axis direction in contact with a fixing belt 5 that meanders. A heating roller 6 that comes close to/departs from the fixing roller 3 is provided with an adjustable member 41 that causes the heating roller 6 to move in the direction orthogonal to the axis direction in linkage with movement of the regulating member 40. The adjustable member 41 does not move in the axis direction and moves freely in the direction orthogonal to the axis direction. The meandered fixing belt 5 is displaced to one side of the axis direction to collide with the regulating member 40. The regulating member 40 is pushed by the fixing belt 5 to move toward one side. The adjustable member 41 is pushed by the regulating member 40 to move in the direction orthogonal to the axis direction, and the heating roller 6 moves so as to depart from the fixing roller 3. A center distance of axes between the fixing roller 3 and the heating roller 6 on one side enlarges, and the fixing belt 5 moves toward the other side. Accordingly, it is possible to suppress the meandering without applying force directly to the fixing belt 5 that meanders.

8 Claims, 8 Drawing Sheets

FIXING APPARATUS

BACKGROUND OF THE INVENTION

1. Field of the Invention

The present invention relates to a fixing apparatus for fixing toner in an image processing apparatus.

2. Description of the Related Art

An image processing apparatus for forming an image by an electrophotographic method is able to form an image having an excellent image quality grade easily, and has been widely used as a copier, a printer, a facsimile apparatus, a multifunctional machine and the like. The image processing apparatus includes a photoreceptor, a charging apparatus, an exposure apparatus, a developing apparatus, a transfer apparatus and a fixing apparatus. The image processing apparatus executes a charging step, an exposure step, a developing step, a transferring step and a fixing step with use of a photoreceptor and these apparatuses, and forms an image on a recording sheet.

When, for example, a belt fixing method is used for the fixing apparatus, the fixing apparatus includes a heating roller, a fixing belt, a fixing roller and a pressurizing roller. The fixing belt is looped over the fixing roller and the heating roller. The fixing roller and the pressurizing roller come into pressure-contact with each other by sandwiching the fixing belt. A heat source such as a halogen heater is provided inside the heating roller.

While the fixing belt is rotated, the fixing belt is displaced in an axis direction and meandering of the fixing belt occurs. In order to prevent such meandering, a roller is provided with a rotatable deviation prevention member. An end of the fixing belt is stricken to the deviation prevention member, thereby suppressing meandering of the belt.

However, there is a problem that the end of the fixing belt is easily broken in the case where the end of the fixing belt is stricken. Hence, in Japanese Patent Laid-Open No. 2008-58458, an end surface of the deviation prevention member in contact with the end of the fixing belt is a tapered surface and the deviation prevention member is biased on the side of the fixing belt. The deviation prevention member comes into contact partially with the end of the fixing belt to positively push the fixing belt back to an original position with a bias force.

Since the above-described deviation prevention member pushes the fixing belt that meanders and comes closer back so that the fixing belt is pushed with a strong force even in the case the contact time is short. Therefore, it is impossible to prevent damage of the end of the fixing belt completely.

In view of the above-described circumstance, it is an object of the present invention to provide a fixing apparatus capable of suppressing meandering of a fixing belt even without applying force directly to the fixing belt.

SUMMARY OF THE INVENTION

The present invention is to include a fixing belt that is looped over a pair of rollers to rotate and a pressurizing roller that comes into pressure-contact with the fixing belt, the pair of the rollers is capable of coming close to/departing from each other, a regulating member that comes into contact with the meandered fixing belt to move in an axis direction is provided in one of the rollers, an adjustable member that causes the other roller to move in the direction orthogonal to the axis direction in linkage with movement of the regulating member is provided in the other roller and the space between both rollers is adjusted according to meandering of the fixing belt so that the fixing belt is moved to one side.

When the fixing belt meanders, the fixing belt is displaced to any one of both sides of the axis direction. At the time, the fixing belt collides with the regulating member, and the regulating member moves toward one side. With use of force that is generated by such movement, the adjustable member causes the other roller to move in the direction orthogonal ito the axis direction. On one side of the axis direction, one of the rollers departs from the other roller. On the other side of the axis direction, the space between both rollers in the direction orthogonal ito the axis direction is not changed. On both sides of the axis direction, the difference is generated in the tension of the fixing belt, and the fixing belt approaches toward the other side. Thus, the meandering of the fixing belt is resolved. At the time, there is no difference of the space between both rollers in the direction orthogonal ito the axis direction on both sides of the axis direction.

The adjustable member is regulated to move in the axis direction as well as capable of being displaced in the direction orthogonal ito the axis direction, the adjustable member is displaced in the direction orthogonal ito the axis direction by movement of the regulating member, and one of the rollers comes close to/departs from the other roller. Even when the regulating member moves in the axis direction, the adjustable member does not move in the axis direction and is displaced only in the direction orthogonal ito the axis direction. One of the rollers moves in the direction orthogonal ito the axis direction according to the displacement of the adjustable member. The space between both rollers changes according to the amount of the displacement due to the meandering of the fixing belt.

Then, when the fixing belt meanders to be displaced, the regulating member moves in the axis direction, the adjustable member is displaced in the direction orthogonal ito the axis direction, and one side of one of the rollers departs from one side of the other roller. When the meandering of the fixing belt is resolved, the one side of one of the rollers approaches the one side of the other roller. The adjustable member is displaced in a reverse direction, and the regulating member moves backward of the axis direction. At the time, the fixing belt does not collide with the regulating member.

The regulating member includes a regulation portion that comes into contact with an end surface of the fixing belt and an action portion that acts on the adjustable member, the regulation portion comes into contact with the fixing belt, thereby moving in the axis direction, the action portion acts on the adjustable member due to the movement of the regulation portion, and the adjustable member is displaced in the direction orthogonal ito the axis direction upon receiving the action of the action portion to cause a support shaft of one of the rollers to move in the direction orthogonal ito the axis direction.

The regulation portion moves in contact with the fixing belt. The action portion causes the force generated by the movement to act on the adjustable member. That is, the action portion converts the force in the axis direction into the force in the direction orthogonal ito the axis direction to apply the force to the adjustable member. The adjustable member is displaced in the direction orthogonal ito the axis direction upon receiving the force from the action portion.

When one of the rollers and the other roller revolve, the regulating member composed of the regulation portion and the action portion that are integrally formed is fitted in a support shaft of one of the rollers that revolves so as to revolve freely, and the adjustable member is fitted in the support shaft of the other roller that revolves so as to revolve freely to contact with the action portion. Since the adjustable portion and the action portion revolve freely for each other, both of them revolve in contact with each other regardless of revolving of each roller so that there is no load from each roller that applies to both of them.

When one of the rollers is able to revolve freely and the other roller is a roller that does not revolve, the regulation portion is fitted in the support shaft of one of the rollers so as to revolve freely as well as so as to move freely in the axis direction, the action portion is provided on the same shaft as that of the regulation portion so as to move freely in the axis direction as well as so as not to revolve, and the adjustable member is fitted in the support shaft of the other roller so as not to revolve to come into contact with the action portion. The adjustable member and the action portion contact with each other without revolving, and there is no unreasonable force that applies to both of them.

One of the rollers serves as the fixing roller opposite to the pressurizing roller by sandwiching the fixing belt, and the other roller serves as the heating roller having a heating element. In this case, the fixing roller does not move in the direction orthogonal ito the axis direction. The heating roller moves so as to come close to/depart from the fixing roller.

The adjustable member doubles as a thermal insulating bush for preventing heat radiation from the end of the heating roller in the axis direction. This makes it possible to diminish the number of components.

According to the present invention, the force generated due to the meandering of the fixing belt is used for adjusting distance between axes of a pair of the rollers with the fixing belt that is looped over so that the meandering of the fixing belt is able to be suppressed. Accordingly, since the force is not applied directly to the fixing belt, it is possible to prevent damage of the end of the fixing belt.

DETAILED DESCRIPTION OF THE PREFERRED EMBODIMENTS

Figure 1:
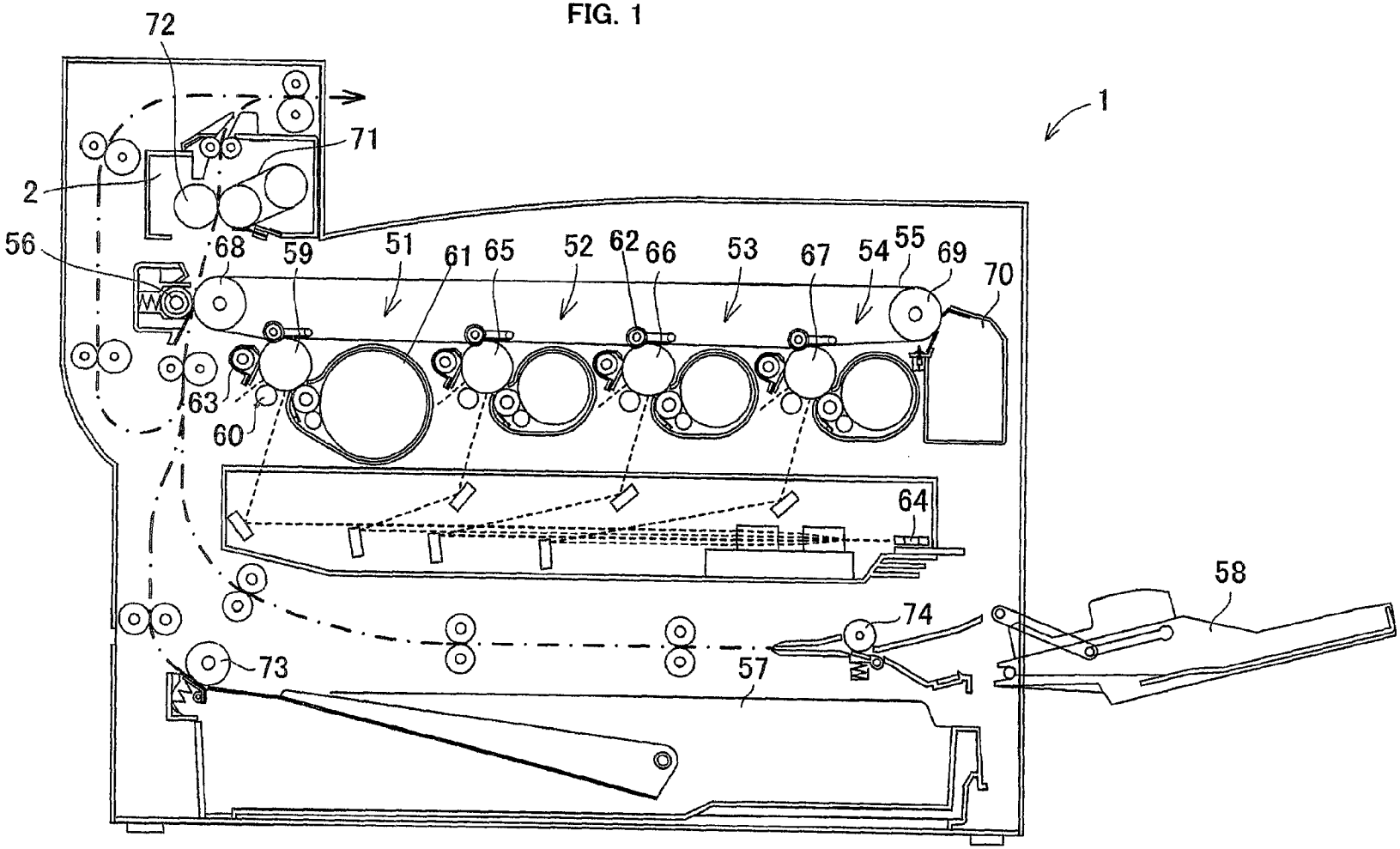
FIG. 1 is an overall configurational view of an image processing apparatus of the present invention.

An image processing apparatus provided with a fixing apparatus of the present embodiment is shown in FIG. 1. Such an image processing apparatus 1 is a color multi-functional machine, which is provided with first to fourth visible image forming units 51, 52, 53 and 54, an intermediate transfer belt 55, a secondary transfer unit 56, a fixing unit 2, an internal paper feed unit 57 and a manual paper feed unit 58. A toner image is formed with the first to fourth visible image forming units 51, 52, 53 and 54, the intermediate transfer belt 55 and the secondary transfer unit 56.

The first visible image forming unit 51 includes a photoreceptor 59, a charging unit 60, a not-shown optical system unit, a developing unit 61 and a primary transfer unit 62. The charging unit 60, the developing unit 61 and a cleaning unit 63 are disposed around the photoreceptor 59 that serves as an image carrier. With these units, a toner image is formed on the photoreceptor 59, and the toner image is transferred to the intermediate transfer belt 55. In the optical system unit, data from a light source 64 is disposed so as to reach four sets of photoreceptors 59, 65, 66 and 67. The primary transfer unit 62 is disposed in pressure-contact with the first visible image forming unit 51 via the intermediate transfer belt 55.

The other second to fourth visible image forming units 52, 53 and 54 have configurations similar to that of the first visible image forming unit 51. In the developing unit 61 of each of units 51, 52, 53 and 54, toner of each color of yellow (Y), magenta (M), cyan (C) and black (B) is contained.

In the intermediate transfer belt 55, a toner image of each color is transferred, and a color toner image is formed. The intermediate transfer belt 55 is rotated with tension rollers 68 and 69. On the tension roller 69 side, a waste toner box 70 is disposed in contact with the intermediate transfer belt 55. The secondary transfer unit 56 transfers the color toner image formed on the intermediate transfer belt 55 onto a recording sheet. The secondary transfer unit 56 is disposed on the tension roller 68 side in contact with the intermediate transfer belt 55. A fixing unit 2 is a fixing apparatus of the present invention. The fixing unit 2 is disposed on the downstream side of the secondary transfer unit 56. The fixing unit 2 is composed of a fixing portion 71 and a pressurizing portion 72, and the pressurizing portion 72 is brought into pressure-contact with the fixing portion 71 due to predetermined pressure by a not-shown pressurizing mechanism.

Description will be given for steps of image formation in the above-described image processing apparatus 1. After uniformly charging the surface of the photoreceptor 59 with the charging unit 60, the surface of the photoreceptor 59 is subjected to laser exposure by the optical system unit corresponding to image information, and an electrostatic latent image is formed on the surface of the photoreceptor 59. For the charging unit 60, a charging roller method is employed in order to charge the surface of the photoreceptor 59 uniformly so as not to generate ozone as much as possible. With the developing unit 61, the electrostatic latent image on the photoreceptor 59 is developed, and a toner image is formed. With the primary transfer unit 62 in which bias voltage with polarity opposite to that of the toner is applied, a visualized toner image is transferred onto the intermediate transfer belt 55. The other three sets of the second to fourth visible image forming units 52, 53 and 54 are operated in the same manner to transfer the toner image onto the intermediate transfer belt 55 sequentially.

The toner image on the intermediate transfer belt 55 is conveyed to the secondary transfer unit 56. To the recording sheet fed from a paper feed roller 73 of the internal paper feed unit 57 or from a paper feed roller 74 of the manual paper feed unit 58, the bias voltage with polarity opposite to that of the toner is applied, and the toner image is transferred onto the recording sheet. The recording sheet that carries the toner image is conveyed to the fixing unit 2 to be sufficiently heated by the fixing portion 71 and the pressurizing portion 72, and the toner image is fused and adhered to the recording sheet, which is discharged outside.

Figure 2:
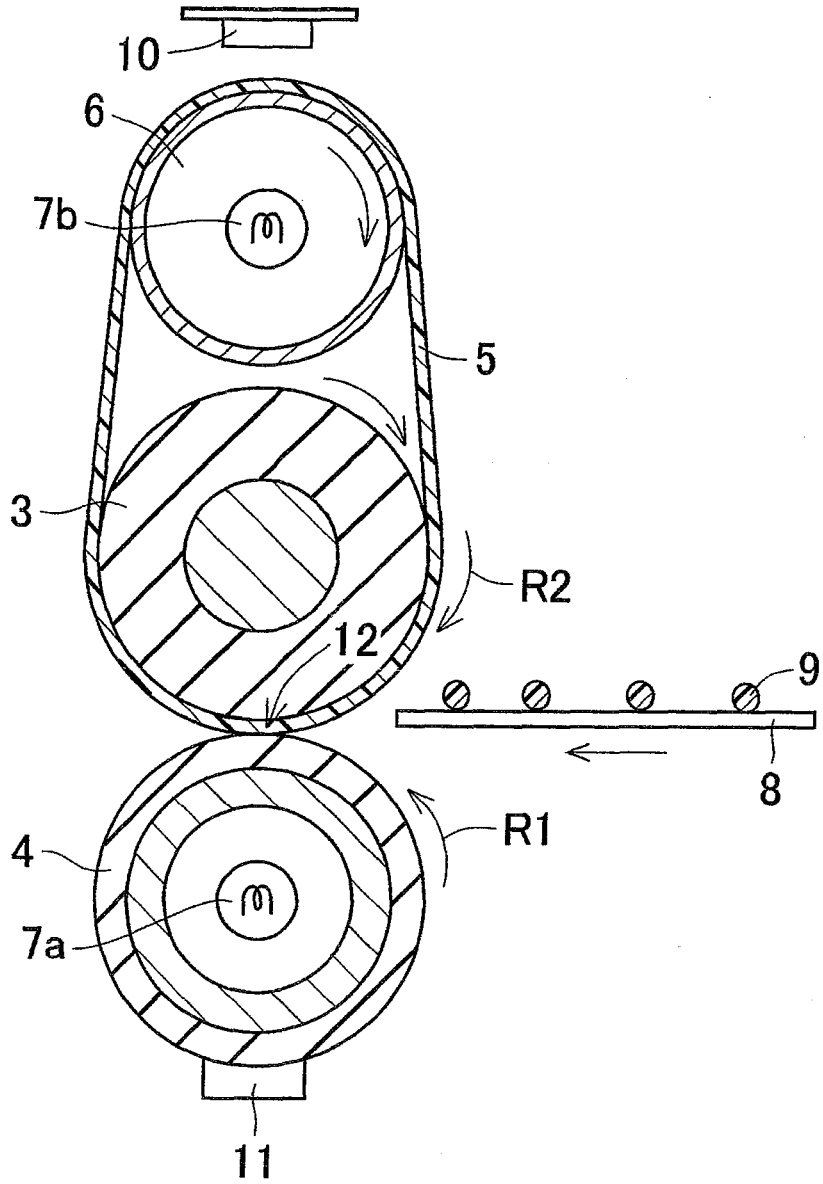
FIG. 2 is a sectional view showing a schematic constitution of a fixing apparatus.

Next, the fixing apparatus in the above-described image processing apparatus 1 is shown in FIG. 2. The fixing unit 2 is provided with a fixing roller 3, a pressurizing roller 4, a fixing belt 5 with no ends and a heating roller 6 for heating the fixing belt 5. The fixing belt 5 is looped over the fixing roller 3 and the heating roller 6.

The heating roller 6 includes therein a heater lamp 7*b* and the pressurizing roller 4 includes therein a heater lamp 7*a*. As a temperature sensor that detects the temperature of the fixing belt 5 and the pressurizing roller 4, a first thermistor 10 and a second thermistor 11 are provided for each rollers 4 and 5, respectively.

The fixing roller 3 is formed in an approximately cylindrical shape, and has a double-layered structure in which a cored bar and an elastic layer are formed toward the periphery from the center of the approximately cylindrical shape. For the cored bar, metal such as iron, stainless steel, aluminum, copper or the like, or alloy thereof is used. For the elastic layer, a rubber material having heat resistance such as silicon rubber, fluororubber or the like is suited. In the present embodiment, the diameter of the fixing roller 3 is 30 mm. For the cored bar, stainless steel with a diameter of 20 mm is used, and for the elastic layer, silicon sponge rubber with a thickness of 5 mm is used.

The pressurizing roller 4 is formed in an approximately cylindrical shape, and has a triple-layered structure in which a cored bar, an elastic layer and a mold releasing layer are formed toward the periphery from the center of the approximately cylindrical shape. For the cored bar, metal such as iron, stainless steel, aluminum, copper or the like, or alloy thereof is used. For the elastic layer, a rubber material having heat resistance such as silicon rubber, fluororubber or the like is suited. For the mold releasing layer, fluorine resin such as PFA (copolymer of tetrafluoroethylene and perfluoroalkyl vinyl ether) or PTFE (polytetrafluoroethylene) is suited. In the present embodiment, the diameter of the pressurizing roller 4 is 30 mm. For the cored bar, iron (STKM) with a diameter of 26 mm and a thickness of 1 mm is used. For the elastic layer, silicon solid rubber with a thickness of 1 mm is used. For the mold releasing layer, a PFA tube with a thickness of 50 μm is used.

The pressurizing roller 4 is disposed opposite to the fixing roller 3 by sandwiching the fixing belt 5. Between the fixing belt 5 and the pressurizing roller 4, a part in which the fixing roller 3 and the pressurizing roller 4 come into contact with each other via the fixing belt 5 serves as a fixing nip portion 12.

The heating roller 6 is formed in an approximately cylindrical shape, and has a triple-layered structure in which an infrared absorbing layer, a cored bar and a protective layer are formed toward the periphery from the center of the approximately cylindrical shape. A heat-resistant carbon-containing paint is applied and calcined inside the cored bar, and thereby the infrared absorbing layer is formed. For the cored bar, for example, metal such as iron, stainless steel, aluminum, copper or the like, or alloy thereof is used. For the protective layer, fluorine resin such as PFA (copolymer of tetrafluoroethylene and perfluoroalkyl vinyl ether) or PTFE (polytetrafluoroethylene) is suited. The protective layer prevents a polyimide layer of the fixing belt 5 and the heating roller 6 from suffering abrasion by contacting with the fixing belt 5 and heating roller 6.

In the present embodiment, the diameter of the heating roller 6 is 28 mm, carbon black coating with a thickness of 100 μm is used for the infrared absorbing layer, and hollow aluminum with a diameter of 28 mm and a thickness of 1 mm is used for the cored bar. For the protective layer, PTFE coating with a thickness of 50 μm is used.

The heater lamp 7*a* is disposed inside the pressurizing roller 4, and the heater lamp 7*a* heats the pressurizing roller 4. A not-shown control apparatus controls a power circuit, and the heater lamp is powered (energized) from the power circuit. The heater lamp 7*a* emits light and infrared rays are radiated from the heater lamp 7*a*. An inner circumferential surface of the pressurizing roller 4 absorbs the infrared rays radiated from the heater lamp 7*a*, thereby heating the entire pressurizing roller 4. In the present embodiment, the heater lamp 7*a* with rated power of 300 W is used.

The heater lamp 7*b* is disposed inside the heating roller 6. A control apparatus controls a power circuit, and the heater lamp 7*b* is powered (energized). The heater lamp 7*b* emits light and infrared rays are radiated from the heater lamp 7*b*. An inner circumferential surface of the heating roller 6 absorbs the infrared rays radiated from the heater lamp 7*b*, thereby heating the entire heating roller 6. In the present embodiment, the heater lamp 7*b* with rated power of 900 W is used.

The fixing belt 5 has a diameter of 50 mm in a state of not being installed. The fixing belt 5 has a triple-layered structure of a substrate, an elastic layer and a mold releasing layer. The substrate is formed in a hollow cylindrical shape with high-temperature resin such as polyimide or a metal material such as stainless steel and nickel. On the surface of the substrate, an elastic layer made of an elastomer material such as, for example, silicon rubber whose heat resistance and elasticity are excellent is formed. On the surface of the elastic layer, the mold releasing layer made of a synthetic resin material which is fluorine resin such as, for example, PFA or PTFE whose heat resistance and mold releasing properties are excellent is formed. In the present embodiment, polyimide with a thickness of 50 μm is used as the substrate, silicon rubber with a thickness of 150 μm is used for the elastic layer and a PFA tube with a thickness of 30 μm is used for the mold releasing layer.

Figure 3:
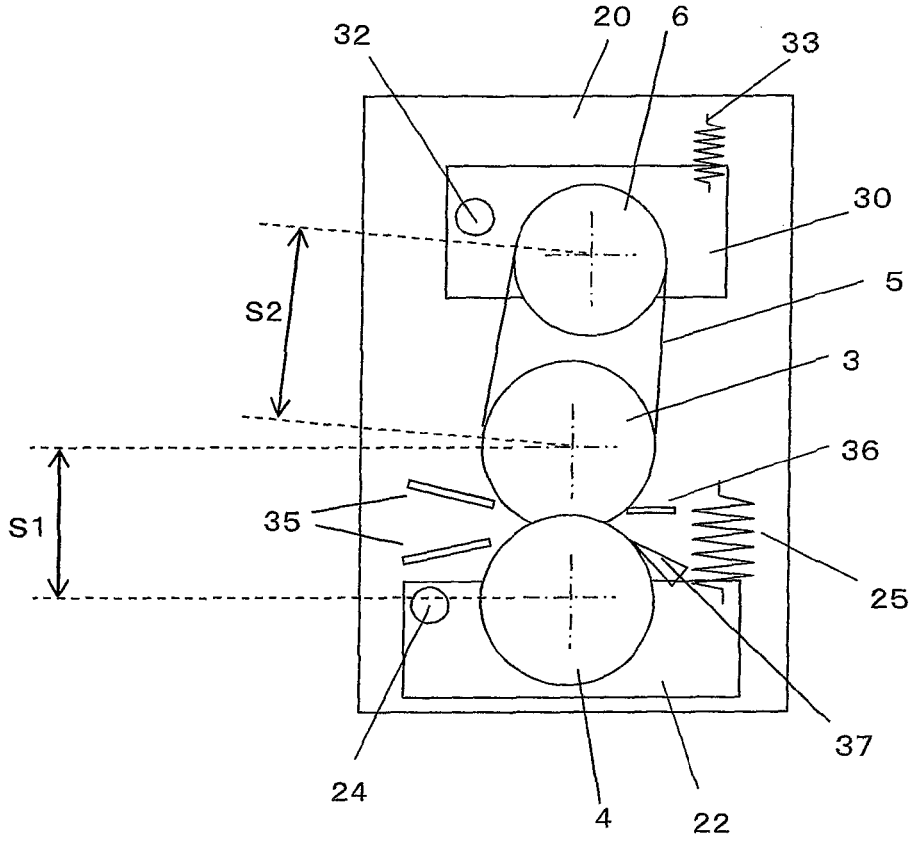
FIG. 3 is a diagram showing a supporting structure of each roller in the fixing apparatus.

As shown in FIG. 3, the fixing roller 3, the pressurizing roller 4 and the heating roller 6 are provided in a mainframe 20 that configures the fixing unit 2 so as to revolve freely, respectively. The heating roller 6 is provided so as to be able to come close to/depart from the fixing roller 3.

The pressurizing roller 4 is rotatably driven by a motor. Support shafts on both sides of the pressurizing roller 4 are supported by a support frame 22 via a bearing so as to revolve freely. The support frame 22 is supported by the mainframe 20 via a spindle 24 so as to revolve freely. One of the support shafts is connected to a motor shaft of the motor via a gear. When the control apparatus controls over revolving of the motor, the pressurizing roller 4 revolves.

The pressurizing roller 4 is pressurized toward the fixing belt 5. A spring 25 that biases the pressurizing roller 4 in the direction that comes close to the fixing roller 3 is provided. The spring 25 serves as a tensile coil spring, one end of the spring 25 is connected to the support frame 22 and the other end is connected to the mainframe 20. The bias force of the spring 25 allows the support frame 22 to rotate in a counterclockwise direction around the spindle 24 as a center, and the pressurizing roller 4 is biased in the direction that comes into pressure-contact with the fixing roller 3 by sandwiching the fixing belt 5. At the time, the center of the fixing roller 3 and the center of the pressurizing roller 4 are retained by constant center distance of axes S1.

Support shafts on both sides of the fixing roller 3 are supported by the mainframe 20 via a bearing so as to revolve freely. Support shafts on both sides of the heating roller 6 are supported by a support frame 30 via a bearing so as to revolve freely. The support frame 30 is supported by the mainframe 20 via a spindle 32 so as to rotate freely.

A spring 33 that biases the heating roller 6 in the direction that departs from the fixing roller 3 is then provided. The spring 33 serves as a tensile coil spring, one end of the spring 33 is connected to the support frame 30 and the other end is connected to the mainframe 20. The bias force of the spring 33 allows the support frame 30 to rotate in a counterclockwise direction around the spindle 32 as a center, and the heating roller 6 is biased in the direction that departs from the fixing roller 3. Therefore, a predetermined load, for example, 50N, is imparted to the fixing belt 5. Tension is imparted to the fixing belt 5. At the time, the center of the fixing roller 3 and the center of the heating roller 6 are retained by constant center distance of axes S2.

As shown in FIG. 2, when the pressurizing roller 4 is rotatably driven in an arrow R1 direction, the fixing belt 5 brought into pressure-contact therewith rotates in an R2 direction. As driven by the rotation of the fixing belt 5, the fixing roller 3 revolves in the same direction as that of the fixing belt 5, that is, in the direction opposite to that of the pressurizing roller 4. Further, since the fixing belt 5 is applied with tension, the heating roller 6 revolves in the same direction along with the rotation of the fixing belt 5.

The fixing roller 3 and the pressurizing roller 4 are brought into pressure-contact with each other with a predetermined load, for example, 400N. The width of the fixing nip portion 12 in the direction in which the recording sheet is conveyed (hereinafter, referred to as a "nip width") is 7 mm. In the fixing nip portion 12, a recording sheet 8 on which an unfixed toner image is carried is fed. The recording sheet 8 is conveyed by the fixing belt 5 and the pressurizing roller 4.

The fixing belt 5 is heated to a predetermined temperature by the heating roller 6. When the recording sheet 8 passes through the fixing nip portion 12, the fixing belt 5 comes into contact with the surface of the recording sheet 8 on which a toner image is formed, and the pressurizing roller 4 comes into contact with the surface on the opposite side to the surface in which the toner image is formed in the recording sheet 8. The fixing belt 5 heats, while pressurizing, the recording sheet 8 that passes through the fixing nip portion 12. The recording sheet 8 on which toner 9 is carried passes through the fixing nip portion 12, and a toner image is thus fixed on the recording sheet 8. Note that, in FIG. 3, 35 denotes a paper feeding guide, 36 denotes a separation plate and 37 denotes a lower separator pawl.

Figure 4:
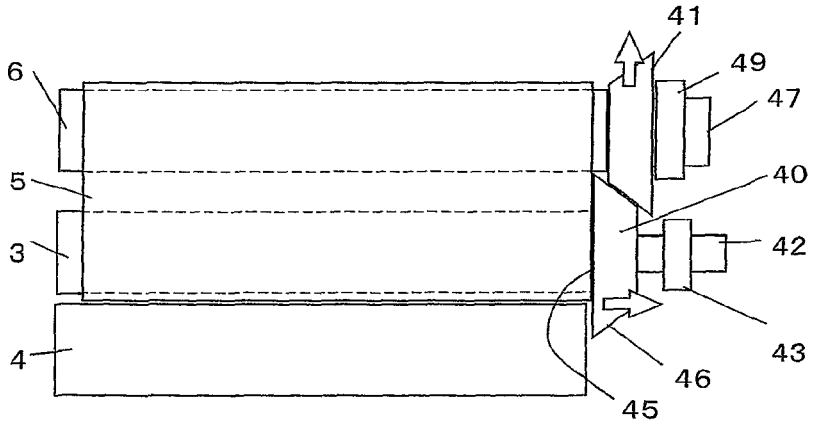
FIG. 4 is a diagram showing a meandering prevention mechanism.
Figure 5:
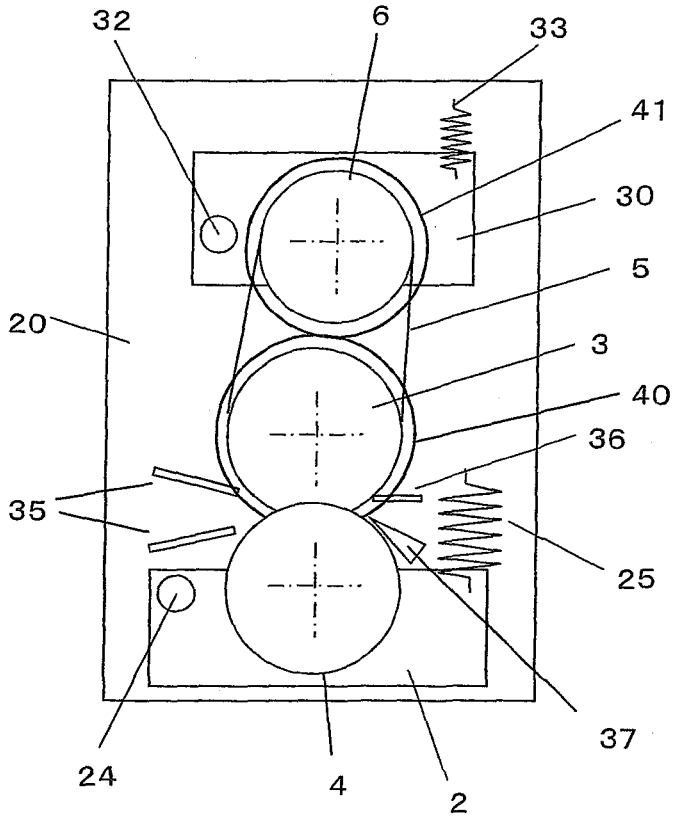
FIG. 5 is a diagram showing a supporting structure of each roller provided with the meandering prevention mechanism.

In the fixing unit 2, the fixing belt 5 meanders while rotating to be displaced in the axis direction. A meandering prevention mechanism is provided in order to prevent the meandering of the fixing belt 5. As shown in FIGS. 4 and 5, a regulating member 40 that moves in the axis direction according to displacement when the fixing belt 5 is displaced in the axis direction and an adjustable member 41 that adjusts center distance of axes between the fixing roller 3 and the heating roller 6 in linkage with the regulating member 40 are provided.

The regulating member 40 is provided in the fixing roller 3, and the adjustable member 41 is provided in the heating roller 6. The regulating member 40 moves freely in the axis direction, and the adjustable member 41, although not moving in the axis direction, is enabled to be displaced in the direction orthogonal to the axis direction. The regulating member 40 contacts the adjustable member 41. When the regulating member 40 moves due to the meandering of the fixing belt 5, the adjustable member 41 is pushed by the regulating member 40 to be displaced in the direction orthogonal ito the axis direction. The space between both rollers 3 and 6 is adjusted according to the meandering of the fixing belt 5 so that the fixing belt 5 is moved to one side and the meandering of the fixing belt 5 is suppressed.

The regulating member 40 has a cylindrical body whose peripheral surface is a tapered surface, and is fitted in a support shaft 42 of the fixing roller 3 via a bush. The regulating member 40 revolves freely for the support shaft 42 and moves freely in the axis direction. There is a space between a bearing 43 that supports the support shaft 42 so as to revolve freely and an outer end of the regulating member 40, and the regulating member 40 is able to move toward outside the axis direction. The regulating members 40 are provided on both sides of the fixing roller 3.

The inner end side of the regulating member 40 serves as a regulation portion 45 in contact with the fixing belt 5 and a peripheral surface of the regulating member 40 serves as an action portion 46 that acts on the adjustable member 41. The action portion 46 contacts the adjustable member 41. Here, the regulation portion 45 and the action portion 46 are formed integrally to become the regulating member 40. When an end surface of the meandered fixing belt 5 comes into contact with the regulation portion 45, the regulating member 40 moves toward the outside along the support shaft 42. The action portion 46 also moves, and the action portion 46 adds a force generated by movement to the adjustable member 41.

The adjustable member 41 has a cylindrical body whose peripheral surface is a tapered surface, and is fitted in a support shaft 47 of the heating roller 6. The adjustable member 41 revolves together with the support shaft 47. Both members 40 and 41 are mounted to the support shafts 42 and 47 of respective rollers 3 and 6 so that the peripheral surface of the adjustable member 41 opposes to the peripheral surface of the regulating member 40. The adjustable members 41 are provided on both sides of the heating roller 6.

Figure 6:
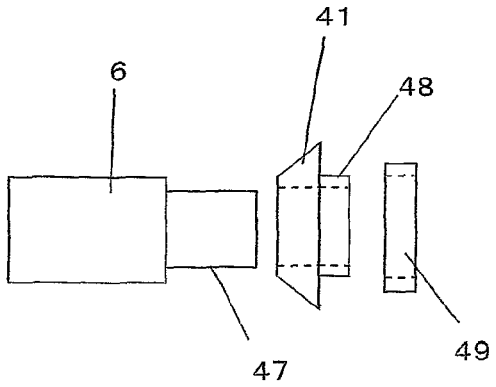
FIG. 6 is a diagram showing a structure of an adjustable member.

As shown in FIG. 6, a part of the adjustable members 41 serves as a thermal insulating bush 48. The thermal insulating bush 48 is placed on an outer end side of the adjustable member 41. A bearing 49 mounted to a support frame 30 is fitted in the thermal insulating bush 48. The adjustable member 41 is regulated by the bearing 49 so as not to move toward the outside in the axis direction. Therefore, the adjustable member 41 moves in the direction orthogonal to the axis direction with a force received from the action portion 46. With the thermal insulating bush 48, it is possible to prevent the heat from escaping from an end of the heating roller 6 to the frames 20 and 30. A decrease in temperature at an end of the fixing belt 5 is able to be prevented, and enhancement of heating efficiency is able to be achieved.

When the fixing belt 5 is in a steady state of no meandering, the regulating member 40 and the adjustable member 41 are disposed in steady-state positions, respectively, and the regulating member 40 is away from the fixing belt 5. When the fixing belt 5 meanders, the fixing belt 5 is displaced to either side out of both sides of the axis direction. For example, as shown in FIG. 4, when the fixing belt 5 is displaced to a right side in the axis direction, the fixing belt 5 collides with the regulation portion 45 of the regulating member 40. The regulating member 40 is pushed by the fixing belt 5 to move to the right side. Since the action portion 46 of the regulating member 40 contacts the adjustable member 41, the force toward one side of the axis direction is applied to the peripheral surface of the adjustable member 41 through the action portion 46. In this manner, the action portion 46 converts the force of the axis direction received from the fixing belt 5 into the force of the center direction of axes to deliver to the adjustable member 41.

The adjustable member 41 is not able to move in the axis direction since the movement in the axis direction is regulated. Accordingly, the adjustable member 41 moves in the direction orthogonal ito the axis direction so as to depart from the support shaft 42 of the fixing roller 3. Note that, although the regulating member 40 moves in the axis direction in contact with the adjustable member 41, the regulating member 40 revolves freely for the support shaft 42, and the regulating member 40 thus revolves in the direction opposite to the adjustable member 41 according to the rotation of the adjustable member 41.

The adjustable member 41 is displaced in the direction orthogonal ito the axis direction, and thereby the right side of the support shaft 47 of the heating roller 6 departs from the right side of the support shaft 42 of the fixing roller 3. The center distance of axes on the right side enlarges more than the center distance of axes on the left side. The center distance of axes is changed according to a displaced amount due to the meandering of the fixing belt 5. That is, the space between both rollers 3 and 6 is adjusted according to the meandering of the fixing belt 5.

Here, the fixing belt 5 moves to the side in which the center distance of axes is short. That is, the fixing belt 5 deviates to the left side. Then, when right and left tension applied to the fixing belt 5 is balanced, the movement of the fixing belt 5 is stopped. The meandering of the fixing belt 5 is automatically resolved, and the fixing belt 5 returns to the steady state. At the time, the fixing roller 3 and the heating roller 6 retain the constant center distance of axes S2. In this manner, the meandering of the fixing belt 5 is able to be suppressed without applying any force to the fixing belt 5.

When the fixing belt 5 deviates to the left side, the fixing belt 5 departs from the regulating member 40. Since the fixing belt 5 does not contact the regulating member 40 for a long time, stress applied to the end of the fixing belt 5 is reduced, and durability of the fixing belt 5 is improved.

When the fixing belt 5 becomes in the steady state, the right side of the heating roller 6 moves due to the tension of the fixing belt 5 so as to come close to the fixing roller 3. As a result, the adjustable member 41 comes close to the support shaft 47 of the heating roller 6 and pushes the regulating member 40. The regulating member 40 moves to the left side and returns to the steady-state position. Accordingly, when the meandering of the fixing roller 3 is resolved, the regulating member 40 and the adjustable member 41 automatically return to the steady-state positions, respectively.

When the fixing belt 5 is displaced to the left side due the meandering, the fixing belt 5 deviates to the right side by the regulating member 40 and the adjustable member 41 on the left side in the same manner. The meandering of the fixing belt 5 is suppressed and the fixing belt 5 returns to the steady-state position.

Figure 7:
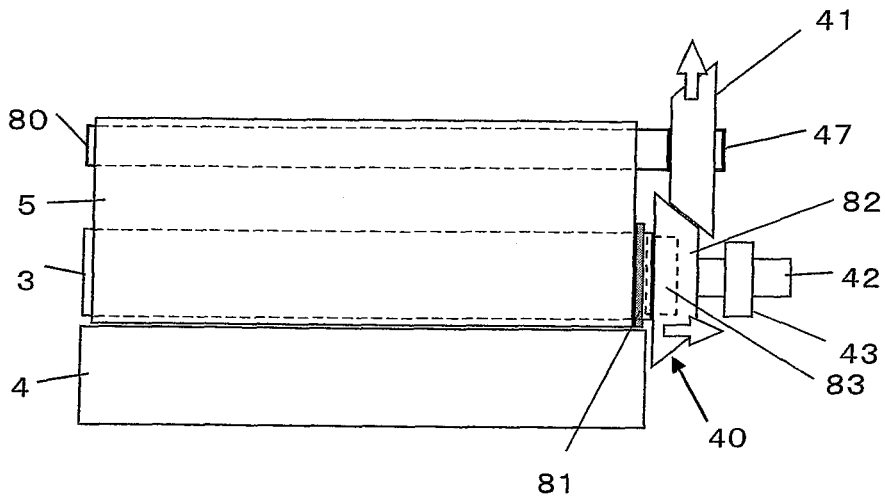
FIG. 7 is a diagram showing the meandering prevention mechanism in the fixing apparatus using a fixed heater.
Figure 8:
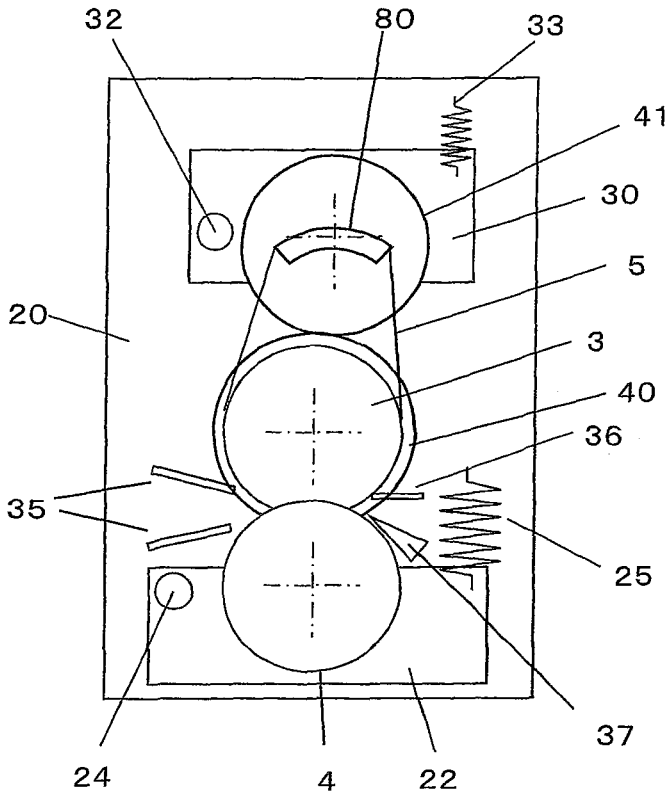
FIG. 8 is a diagram showing a supporting structure of each roller in the fixing apparatus using a fixed heater.

A fixing apparatus in another form is shown in FIGS. 7 and 8. In place of the heating roller 6, a fixed heater 80 is used. As the fixed heater 80, a known heater that is used for office automation equipment is used. The fixed heater 80, whose cross-section is formed in the shape of a circular arc, is fixed to the support frame 30. The structure of the support frame 30 is the same as that of the above-described one, and the fixed heater 80 moves freely in the direction orthogonal ito the axis direction. Then, the fixing belt 5 is looped over the peripheral surface of the fixed heater 80, and the fixing belt 5 rotates, sliding the peripheral surface of the fixed heater 80. That is, the fixed heater 80 serves as a roller that does not revolve. The configuration of the other fixing apparatus 2 is the same as the above-described one.

The adjustable members 41 are provided on the outer end sides of both sides of the fixed heater 80. The adjustable member 41 has the same shape as that of the above-described adjustable member 41, is fitted in the fixed heater 80 and fixed thereto. The adjustable member 41 neither revolves nor moves in the axis direction.

The regulating member 40 provided in the fixing roller 3 is provided with a regulation portion 81 and an action portion 82. The regulation portion 81 and the action portion 82 are included therein as a separated body, respectively. The regulation portion 81 is formed in a ring shape, fitted in the support shaft 42 so as to revolve freely and moves freely in the axis direction. The action portion 82 has a cylindrical body whose peripheral surface is a tapered surface, and is retained in a bearing 83. The bearing 83 is fitted in the support shaft 42 at a position outside the regulation portion 81 and moves freely in the axis direction. An inner ring of the bearing 83 is fitted so as to revolve freely for the support shaft 42 as well as so as to move freely in the axis direction, and the action portion 82 is fitted in an outer ring of the bearing 83. This allows the action portion 82 to move in the axis direction and not to revolve. The regulation portion 81 comes into contact with the inner ring of the bearing 83.

The fixing belt 5, when meandering to be displaced in the axis direction, collides with the regulation portion 81. The regulation portion 81 moves toward the outside. The bearing 83 in contact with the regulation portion 81 moves, and the action portion 82 moves without revolving. The action portion 82 moves so that the adjustable member 41 is pushed, and the adjustable member 41 moves in the direction orthogonal ito the axis direction so as to depart from the support shaft 42 of the fixing roller 3. Since then, the meandering of the fixing belt 5 is resolved in the same manner as described above.

Figure 9:
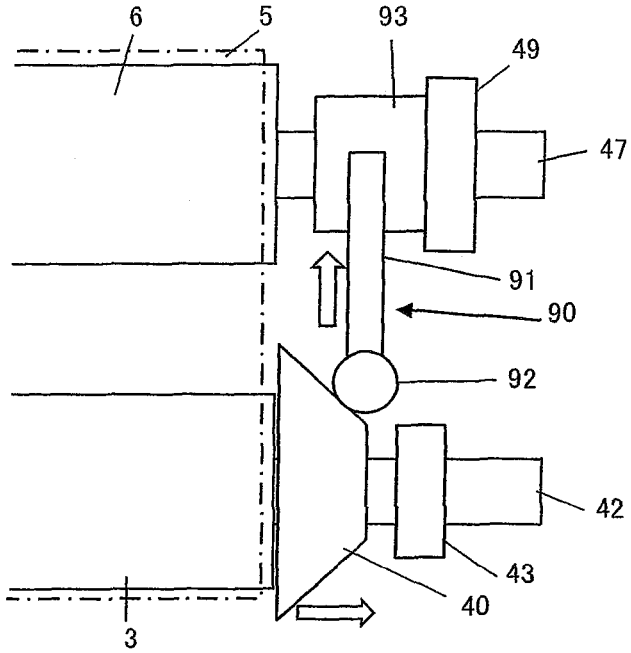
FIG. 9 is a diagram showing the meandering prevention mechanism of other form.

Note that, the present invention is not limited to the above-described embodiment, and many modifications and changes are of course able to be added to the above-described embodiment within the scope of the present invention. As shown in FIG. 9, as the meandering prevention mechanism, a translation cam that changes horizontal movement to vertical movement may be used. The regulating member 40 is the same as the one of the above-described embodiment whose peripheral surface is a tapered surface. An adjustable member serves as a translation cam 90, and a roller 92 is mounted to an end of a rod 91 so as to revolve freely. The other end of the rod 91 is mounted to a thermal insulating bush 93 fitted in the support shaft 47 of the heating roller 6 or to the support frame 30. Note that, the thermal insulating bush 93 does not revolve for the support shaft 47. The rod 91 is guided so as to move in the direction orthogonal ito the axis direction and does not move in the axis direction. A roller 92 comes into contact with a peripheral surface of the regulating member 40. When the regulating member 40 moves in the axis direction, the other end of the rod 91 is displaced in the direction orthogonal ito the axis direction, and the heating roller 6 moves so as to depart from the fixing roller 3.

Figure 10:
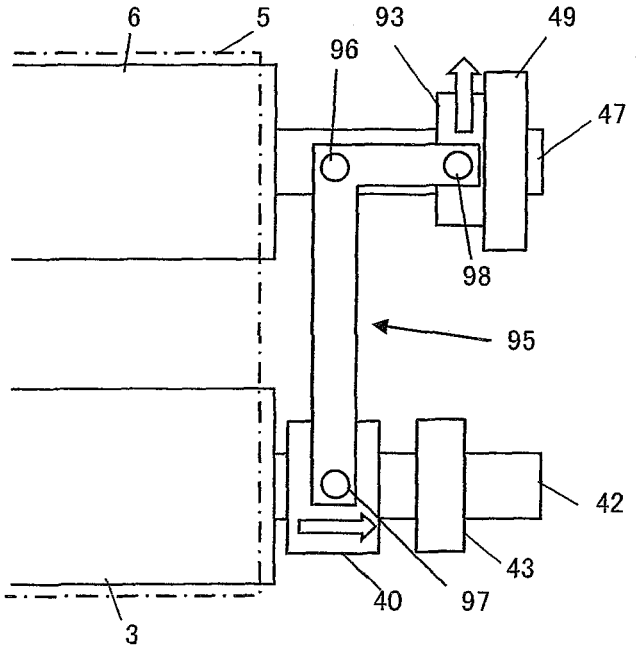
FIG. 10 is a diagram showing the meandering prevention mechanism of other form.

Additionally, as shown in FIG. 10, as the other meandering prevention mechanism, a bell crank may be used. The regulating member 40 serves as a ring fitted in the support shaft 42 of the fixing roller 3 so as to move freely in the axis direction. An adjustable member serves as an L-shaped bell crank 95. A center shaft 96 of the bell crank 95 is supported by the mainframe 20 so as to revolve freely whose one end is mounted to the regulating member 40 so as to revolve freely around an axis 97 and the other end is mounted to the thermal insulating bush 93 fitted in the support shaft 47 of the heating roller 6 or to the support frame 30 so as to revolve freely around an axis 98. When the regulating member 40 moves to the axis direction, an end of the bell crank 95 is pushed and the bell crank 95 revolves around the center shaft 96. The other end of the bell crank 95 is displaced in the direction orthogonal ito the axis direction, and the heating roller 6 moves so as to depart from the fixing roller 3.

What is claimed is:

1. A fixing apparatus comprising:

a fixing belt that is looped over a pair of rollers to rotate; and a pressurizing roller that comes into pressure-contact with the fixing belt, wherein the pair of the rollers is capable of coming close to/departing from each other, a regulating member that comes into contact with the meandered fixing belt to move in an axis direction is provided in one of the rollers, an adjustable member that causes the other roller to move in the direction orthogonal to the axis direction in linkage with movement of the regulating member is provided in the other roller, the adjustable member is regulated so as not to move in the axis direction as well as capable of being displaced in the direction orthogonal to the axis direction, the adjustable member is displaced in the direction orthogonal to the axis direction by movement of the regulating member, and one of the rollers comes close to/departs from the other roller, and the space between both rollers is adjusted according to meandering of the fixing belt so that the fixing belt is moved to one side.

2. The fixing apparatus according to claim 1, wherein the regulating member includes a regulation portion that comes into contact with an end surface of the fixing belt and an action portion that acts on the adjustable member, in which the regulation portion comes into contact with the fixing belt, thereby moving in the axis direction, the action portion acts on the adjustable member due to the movement of the regulation portion, and the adjustable member is displaced in the direction orthogonal to the axis direction upon receiving the action of the action portion to cause a support shaft of one of the rollers to move in the direction orthogonal to the axis direction.

3. The fixing apparatus according to claim 2, wherein the regulating member composed of the regulation portion and the action portion that are integrally formed is fitted in a support shaft of one of the rollers that revolves so as to revolve freely, and the adjustable member is fitted in the support shaft of the other roller that revolves so as to revolve freely to contact with the action portion.

4. The fixing apparatus according to claim 2, wherein one of the rollers is able to revolve freely, the other roller is a roller that does not revolve, the regulation portion is fitted in the support shaft of one of the rollers so as to revolve freely as well as so as to move freely in the axis direction, the action portion is provided on the same shaft as that of the regulation portion so as to move freely in the axis direction as well as so as not to revolve, and the adjustable member is fitted in the support shaft of the other roller so as not to revolve to come into contact with the action portion.

5. The fixing apparatus according to claim 1, wherein one of the rollers serves as the fixing roller opposite to the pressurizing roller by sandwiching the fixing belt, and the other roller serves as the heating roller having a heating element.

6. The fixing apparatus according to claim 5, wherein the adjustable member doubles as a thermal insulating bush for preventing heat radiation from the end of the heating roller in the axis direction.

7. A fixing apparatus comprising:

a fixing belt that is looped over a pair of rollers to rotate; and a pressurizing roller that comes into pressure-contact with the fixing belt, wherein the pair of the rollers is capable of coming close to/departing from each other, a regulating member that comes into contact with the meandered fixing belt to move in an axis direction is provided in one of the rollers, an adjustable member that causes the other roller to move in the direction orthogonal to the axis direction in linkage with movement of the regulating member is provided in the other roller, one of the rollers serves as the fixing roller opposite to the pressurizing roller by sandwiching the fixing belt, and the other roller serves as the heating roller having a heating element, the adjustable member doubles as a thermal insulating bush for preventing heat radiation from the end of the heating roller in the axis direction, and the space between both rollers is adjusted according to meandering of the fixing belt so that the fixing belt is moved to one side.

8. An image processing apparatus comprising the fixing apparatus according to claim 7.

* * * * *